US010912386B2

(12) United States Patent
Xuemin

(10) Patent No.: US 10,912,386 B2
(45) Date of Patent: Feb. 9, 2021

(54) EASY TO DISASSEMBLE AND ASSEMBLE RATTAN HAMMOCK CHAIR WITH HANGING STAND

(71) Applicant: Piscifun Inc., Boulder, CO (US)

(72) Inventor: Pan Xuemin, Ji'nan (CN)

(73) Assignee: PISCIFUN INC, Boulder, CO (US)

( * ) Notice: Subject to any disclaimer, the term of this patent is extended or adjusted under 35 U.S.C. 154(b) by 0 days.

(21) Appl. No.: 16/420,967

(22) Filed: May 23, 2019

(65) Prior Publication Data

US 2020/0367653 A1 Nov. 26, 2020

(51) Int. Cl.

| | |
|---|---|
| ***A47C 5/02*** | (2006.01) |
| ***A47C 3/025*** | (2006.01) |
| ***A47C 3/12*** | (2006.01) |
| ***A47C 4/03*** | (2006.01) |

(52) U.S. Cl.

CPC ..... *A47C 3/0255* (2013.01); *A47C 3/12* (2013.01); *A47C 4/03* (2013.01); *A47C 5/02* (2013.01)

(58) Field of Classification Search

CPC .... A47C 5/02; A47C 4/03; A47C 3/12; A47C 3/0255

USPC ..... 297/273, 452.8, 452.9, 259.3

See application file for complete search history.

(56) References Cited

U.S. PATENT DOCUMENTS

| | | | | |
|---|---|---|---|---|
| 5,588,702 | A * | 12/1996 | Litwin | A47C 3/0255 297/172 |
| 6,139,109 | A * | 10/2000 | Lajoie | A47C 3/12 269/37 |
| 6,854,801 | B2 * | 2/2005 | Nussbaum | A47C 3/0255 297/279 |
| 7,073,857 | B1 * | 7/2006 | Bailey | A47C 3/0255 224/547 |
| 7,380,880 | B2 * | 6/2008 | Molen | A47C 3/0255 248/188.7 |
| 9,468,284 | B2 * | 10/2016 | Wehner | A45F 3/26 |
| 9,861,181 | B2 * | 1/2018 | Wehner | A45F 3/26 |
| 9,890,554 | B2 * | 2/2018 | Duncan, III | E04H 15/04 |
| 10,016,048 | B2 * | 7/2018 | Wehner | A45F 3/26 |
| 10,398,214 | B2 * | 9/2019 | Wehner | A47C 4/045 |
| 10,631,643 | B2 * | 4/2020 | Lin | A47C 4/02 |
| 2007/0051858 | A1 * | 3/2007 | Bailey | A45F 3/26 248/127 |

FOREIGN PATENT DOCUMENTS

| | | | | |
|---|---|---|---|---|
| GB | 2508369 | A * | 6/2014 | A47C 3/0255 |

OTHER PUBLICATIONS https://www.wayfair.com/outdoor/pdp/mistana-anner-tear-drop-swing-chair-with-stand-mtna1900.html (Year: 2014).*

* cited by examiner

*Primary Examiner* — Syed A Islam
(74) *Attorney, Agent, or Firm* — Bay State IP, LLC

(57) ABSTRACT

An easy to Disassemble and Assemble Rattan Hammock Chair with a Hanging Stand with an upper boom, a bolt, a spring, hook, a safety catch, a lower boom, a split hanging basket, a first split part, a second split part, a circular ring, a third split part, a fourth split part, a cushion, a base. The Chair receives the following beneficial effect: It has the reasonable structural design and is easily mounted and dismounted, thus reducing the transport space, improving the transport efficiency, lowering the transport cost and strengthening the comfort degree, safe and reliable, so it is suitable to promote the use of it.

6 Claims, 2 Drawing Sheets

EASY TO DISASSEMBLE AND ASSEMBLE RATTAN HAMMOCK CHAIR WITH HANGING STAND

BACKGROUND OF THE INVENTION

Field of the Invention

The invention relates to the field of furniture technology, and specifically relates to Easy to Disassemble and Assemble Rattan Hammock Chair with a Hanging Stand.

Description of the Related Art

In the field of furniture, the hanging basket is hung up in the air through a bracket, which can make people feel leisure more. The hand-woven rattan product hanging basket, elegant and generous modeling, unique and novel style, fashionable and diverse, solid and durable. The existing Rattan Hammock Chair in the market, comprising the cradle and the boom. The cradle is hung under the boom through the connecting piece, characterized in that the said connecting piece mainly comprises the bolt, spring and hook. The bolt is inserted in the through-hole on the top of the boom, the spring is hooked in the lower end of the bolt, the lower end of the spring is hung with the hook, and the cradle is hoisted by the hook. Though the invention is provided with the function of rotation and swing within 360° in the cradle, safe and reliable, yet the hanging basket and the boom can't be dismounted and mounted, so the large transport spaces lowers the transport efficiency, the transport cost is high, and it is not comfortable, so it is not suitable to promote the use of it.

SUMMARY OF THE INVENTION

The invention provides an Easy to Disassemble and Assemble Rattan Hammock Chair with Hanging Stand according to the defects and deficiencies of the existing technology. It has the reasonable structural design and is easily mounted and dismounted, thus reducing the transport space, improving the transport efficiency, lowering the transport cost and strengthening the comfort degree, safe and reliable, so it is suitable to promote the use of it.

To this end, the following technical proposal is adopted for invention. It comprises an upper boom 1, a bolt 11, a spring 12, hook 121, a safety catch 13, a lower boom 2, a split hanging basket 3, a first split part 31, a second split part 32, a circular ring 321, a third split part 33, a fourth split part 34, a cushion 35, a base 4. The upper end of the upper boom 1 is welded on the fixed bolt 11, the spring 12 is installed under the bolt 11, the bolt 11 and the spring 12 are connected through the hook 121, the safety catch 13 is installed under the spring 12, the lower boom 2 is installed under the upper boom 1, the upper boom 1 and the lower boom 2 adopt the dismountable connection, the split hanging basket 3 is installed on one side of the upper boom 1 and the lower boom 2, the split hanging basket 3 comprises the first split part 31, second split part 32, third split part 33 and fourth split part 34, the first split part 31 is installed on the left side of the second split part 32, the third split part 33 is installed on the right side of the fourth split part 34, the upper end of the third split part 33 and the second split part 32 is fixed on the connecting circular ring 321, the cushion 35 is installed in the split hanging basket 3, and the lower boom 2 and the base 4 are connected.

The said upper boom 1 and lower boom 2 are connected into a boom 21 through the nuts and bolts, and the bolt 11 is welded on the upper end of the boom 21. The said first split part 31, second split part 32, third split part 33 and fourth split part 34 are connected together through the nuts and bolts, and the first split part (31), second split part 32, third split part 33 and fourth split part 34 adopt the dismountable connection.

The said first split part 31, second split part 32, third split part 33 and fourth split part 34 are installed with the reinforcing rib 341.

The stiffener is installed outside the said base 4, and the upper end of the stiffener 41 is welded on the surface of the lower boom 2.

The said split hanging basket 3 is woven by the flake rattan and circular rattan. Working principle of the invention: The upper boom and the lower boom are assembled into the boom through the nuts and bolts, the upper end of the boom is welded on the bolt, the lower end of the bolt is connected to the spring through the hook, the lower end of the spring is connected to the safety catch through the hook, the safety catch is connected to the split hanging basket through the circular ring, and the cushion is put inside the split hanging basket.

After the above technical proposal is adopted, the invention receives the following beneficial effect: It has the reasonable structural design and is easily mounted and dismounted, thus reducing the transport space, improving the transport efficiency, lowering the transport cost and strengthening the comfort degree, safe and reliable, so it is suitable to promote the use of it.

An easy to Disassemble and Assemble Rattan Hammock Chair with Hanging Stand relates to the field of furniture technology. Easy to Disassemble and Assemble Rattan Hammock Chair with Hanging Stand, comprising an upper boom, a bolt, a spring, hook, a safety catch, a lower boom, a split hanging basket, a first split part, a second split part, a circular ring, a third split part, a fourth split part, a cushion, a base. The upper end of the upper boom is welded on the fixed bolt, the spring is installed under the bolt, the safety catch is installed under the spring, the lower boom is installed under the upper boom, the split hanging basket is installed on one side of the upper boom and the lower boom, the first split part is installed on the left side of the second split part, the third split part is installed on the right side of the fourth split part, the upper end of the third split part and the second split part is fixed on the connecting circular ring, the cushion is installed in the split hanging basket, and the lower boom and the base are connected. After the above technical proposal is adopted, the invention receives the following beneficial effect: It has the reasonable structural design and is easily mounted and dismounted, thus reducing the transport space, improving the transport efficiency, lowering the transport cost and strengthening the comfort degree, safe and reliable, so it is suitable to promote the use of it.

BRIEF DESCRIPTION OF THE DRAWINGS

To better describe the cases adopting this invention embodiment or the technical schemes of current technologies, a brief introduction of attached figures to be used in the descriptions of embodiment or current technologies is made hereby. Obviously, the attached figures described below are only several embodiments of this invention. For common technicians in this field, they can obtain other attached figures based on these without making additional creative endeavors.

Figure 1:
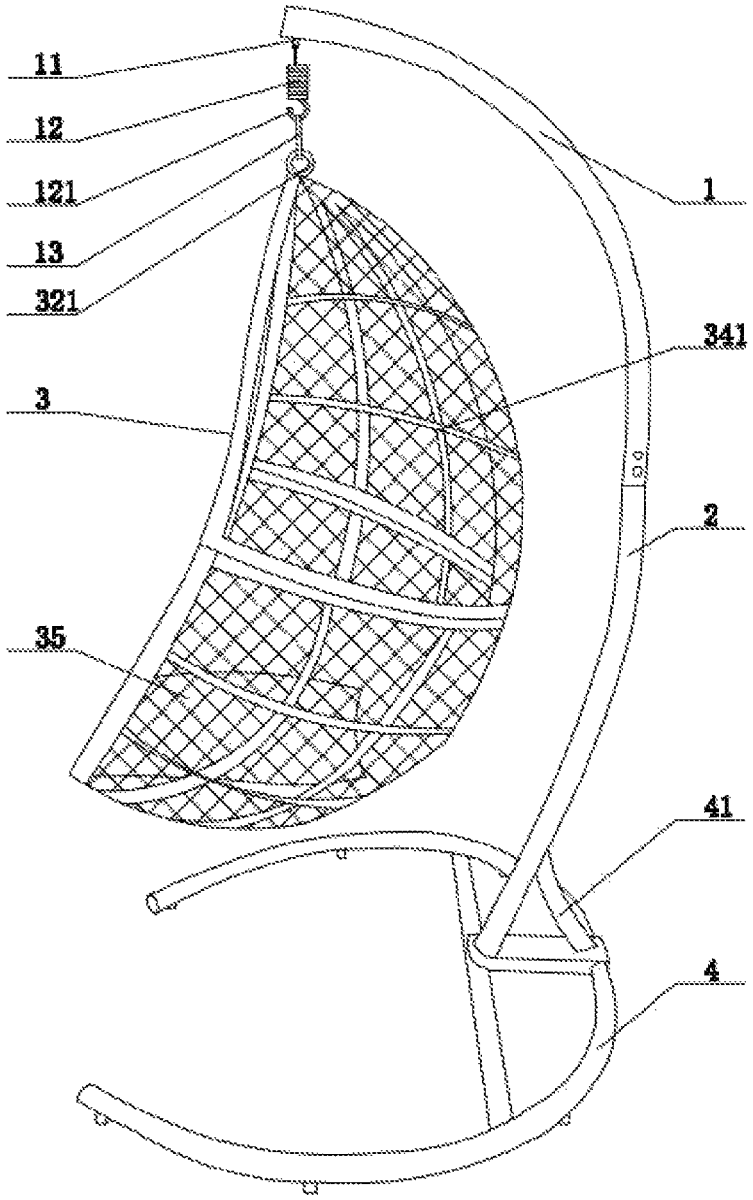
FIG. 1 illustrates a structural diagram of this invention.

Description of the reference signs: Upper boom 1, a bolt 11, a spring 12, hook 121, a safety catch 13, a lower boom 2, a split hanging basket 3, a first split part 31, a second split part 32, a circular ring 321, a third split part 33, a fourth split part 34, reinforcing rib 341, cushion 35, base 4, stiffener 41.

DETAILED DESCRIPTION OF THE SEVERAL EMBODIMENTS

To better describe the cases adopting this invention embodiment or the technical schemes of current technologies, a brief introduction of attached figures to be used in the descriptions of embodiment or current technologies is made hereby. Obviously, the attached figures described below are only several embodiments of this invention. For common technicians in this field, they can obtain other attached figures based on these without making additional creative endeavors.

Figure 2:
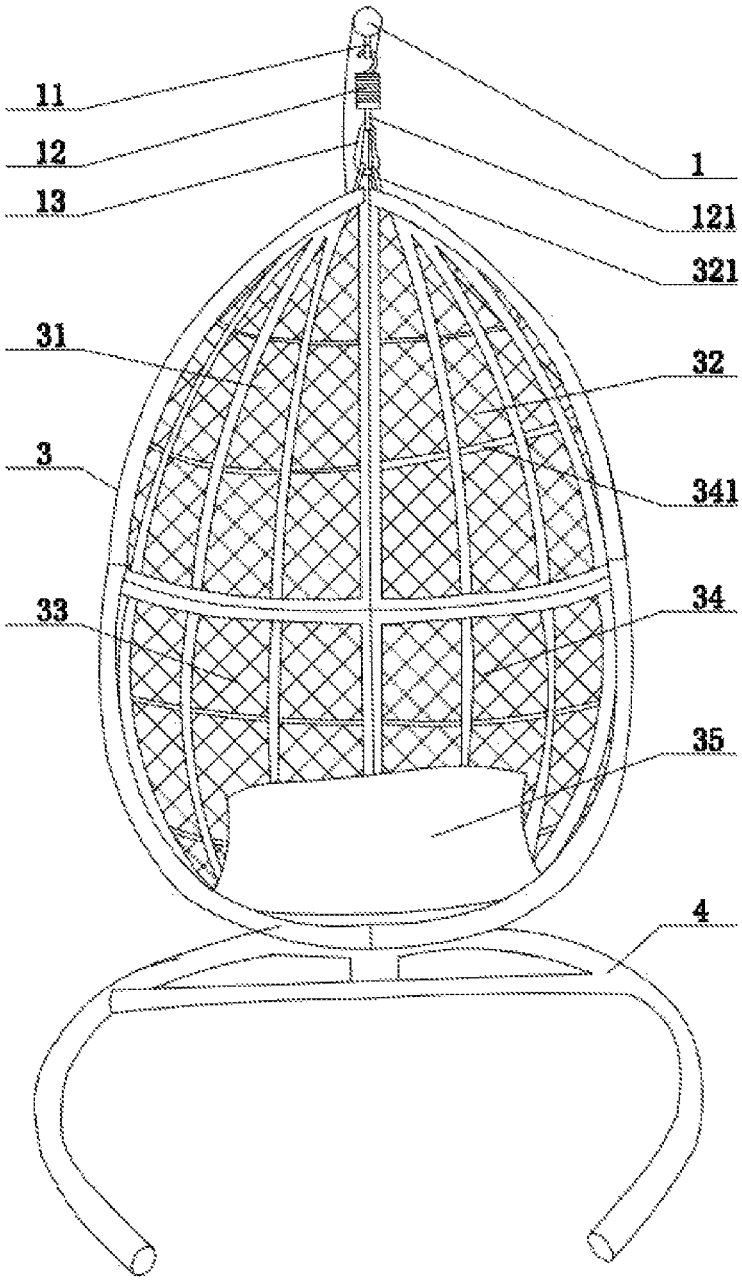
FIG. 2 illustrates a front view of the invention.

As shown in FIG. 1-FIG. 2, the technical proposal adopted by the specific implementation mode is as follows: It comprises an upper boom 1, a bolt 11, a spring 12, hook 121, a safety catch 13, a lower boom 2, a split hanging basket 3, a first split part 31, a second split part 32, a circular ring 321, a third split part 33, a fourth split part 34, a cushion 35, a base 4. The upper end of the upper boom 1 is welded on the fixed bolt 11, the spring 12 is installed under the bolt 11, the hook 121 is installed above and under the spring 12, the hook 121 installed above the spring 12 is connected to the bolt 11, the hook 121 installed under the spring 12 is connected to the safety catch 13, the lower boom 2 is installed under the upper boom 1, the upper boom (1) and the lower boom (2) adopt the dismountable connection, and the dismountable connection reduces the transport space, facilitates the dismounting and mounting, and improves the transport efficiency.

The split hanging basket 3 is connected to the safety catch 13 through the circular ring 321, the split hanging basket 3 comprises the first split part 31, second split part 32, third split part 33 and fourth split part 34, the first split part 31 is installed on the left side of the second split part 32, the third split part 33 is installed on the right side of the fourth split part 34, the second split part 32 is installed above the third split part 33, the upper end of the first split part and the second split part is installed with the circular ring 321 which facilitates the connection with the safety catch 13. The split hanging basket comprises of four split parts, which is to reduce the transport space, improve the transport efficiency and lower the transport cost. The cushion is put inside the split hanging basket 3 which strengthens the comfort degree of the rattan chair with hanging basket, and the base 4 is installed under the split hanging basket 3.

The said upper boom 1 and lower boom 2 are connected through the nuts and bolts, and the upper boom (1) and lower boom (2) are assembled into the boom 21. The boom 21 is made of the steel material, the colored paint is applied to the surface of the boom 21, and the bolt 11 is welded on the surface of the boom 21.

The said first split part 31, second split part 32, third split part 33 and fourth split part 34 are connected together through the nuts and bolts, and the dismountable connection is adopted, which is to reduce the transport space and facilitate the dismounting and mounting.

The said first split part 31, second split part 32, third split part 33 and fourth split part 34 are installed with the two reinforcing ribs 341.

The welding stiffener is installed outside the said base 4, and the upper end face of the stiffener 41 is welded on the surface of the lower boom 2.

The said split hanging basket 3 is woven by the flake rattan and circular rattan, the side surface of the split hanging basket 3 is wound with a layer of flake rattan, and the interior of the split hanging basket 3 is woven by the circular rattan.

Working principle of the invention: The upper boom and the lower boom are assembled into the boom through the nuts and bolts, the upper end of the boom is welded on the bolt, the lower end of the bolt is connected to the spring through the hook, the lower end of the spring is connected to the safety catch through the hook, the safety catch is connected to the split hanging basket through the circular ring, and the cushion is put inside the split hanging basket.

After the above technical proposal is adopted, the invention receives the following beneficial effect: It has the reasonable structural design and is easily mounted and dismounted, thus reducing the transport space, improving the transport efficiency, lowering the transport cost and strengthening the comfort degree, safe and reliable, so it is suitable to promote the use of it.

What is said above is only used to describe rather than restrict the technical proposal of the invention. Other modifications or equivalent replacement made by the ordinary technical personnel in the field for the technical proposal of the invention shall be covered in the scope of Claim of the invention without departing from the spirit and scope of the invention.

What is claimed is:

1. An easy to Disassemble and Assemble Rattan Hammock Chair with a Hanging Stand, comprising:

an upper boom (1);

a bolt (11);

a spring (12);

hook (121);

a safety catch (13);

a lower boom (2);

a split hanging basket (3);

a first split part (31);

a second split part (32);

a circular ring (321);

a third split part (33);

a fourth split part (34);

a cushion (35); and a base (4);

wherein the upper end of the upper boom (1) is welded on the fixed bolt (11), the spring (12) is installed under the bolt (11), the bolt (11) and the spring (12) are connected through the hook (121), the safety catch (13) is installed under the spring (12), the lower boom (2) is installed under the upper boom (1), the upper boom (1) and the lower boom (2) adopt the dismountable connection, the split hanging basket (3) is installed on one side of the upper boom (1) and the lower boom (2), the split hanging basket (3) comprises first split part (31), second split part (32), third split part (33) and fourth split part (34), the first split part (31) is installed on the left side of the second split part (32), the third split part (33) is installed on the right side of the fourth split part (34), the upper end of the first split part (31) and the second split part (32) is fixed on the connecting circular ring (321), the cushion (35) is installed in the split hanging basket (3), and the lower boom (2) and the base (4) are connected.

2. The easy to Disassemble and Assemble Rattan Hammock Chair with a Hanging Stand according to claim 1, wherein the said upper boom (1) and lower boom (2) are connected into a boom (21) through the nuts and bolts, and the bolt (11) is welded on the upper end of the boom (21).

3. The easy to Disassemble and Assemble Rattan Hammock Chair with a Hanging Stand according to claim 1, wherein the said first split part (31), second split part (32), third split part (33) and fourth split part (34) are connected together through the nuts and bolts, and the first split part (31), second split part (32), third split part (33) and fourth split part (34) adopt the dismountable connection.

4. The easy to Disassemble and Assemble Rattan Hammock Chair with a Hanging Stand according to claim 1, wherein the said first split part (31), second split part (32), third split part (33) and fourth split part (34) are installed with the reinforcing rib (341).

5. The easy to Disassemble and Assemble Rattan Hammock Chair with a Hanging Stand according to claim 1, wherein the stiffener is installed outside the said base (4), and the upper end of the stiffener (41) is welded on the surface of the lower boom (2).

6. The easy to Disassemble and Assemble Rattan Hammock Chair with a Hanging Stand according to claim 1, wherein the said split hanging basket (3) is woven by the flake rattan and circular rattan.

* * * * *